US007873492B2

(12) United States Patent
Ackermann

(10) Patent No.: US 7,873,492 B2
(45) Date of Patent: Jan. 18, 2011

(54) METHOD FOR DETERMINING A COMPACTION DEGREE OF ASPHALTS AND SYSTEM FOR DETERMINING A COMPACTION DEGREE

(75) Inventor: Hans-Peter Ackermann, Wondreb (DE)

(73) Assignee: Hamm AG, Tirschenreuth (DE)

( * ) Notice: Subject to any disclaimer, the term of this patent is extended or adjusted under 35 U.S.C. 154(b) by 184 days.

(21) Appl. No.: 12/081,797

(22) Filed: Apr. 22, 2008

(65) Prior Publication Data

US 2008/0260462 A1 Oct. 23, 2008

(30) Foreign Application Priority Data

Apr. 23, 2007 (DE) ..... 10 2007 019 419

(51) Int. Cl.
*G01N 3/00* (2006.01)
*G06F 19/00* (2006.01)

(52) U.S. Cl. ..... 702/150

(58) Field of Classification Search ..... 702/150
See application file for complete search history.

(56) References Cited

U.S. PATENT DOCUMENTS 4,590,802 A * 5/1986 Furmanski ..... 73/573
4,870,601 A * 9/1989 Sandstrom ..... 702/43
5,123,778 A * 6/1992 Bohnhoff ..... 404/28
5,415,494 A * 5/1995 Steffen ..... 404/72
5,471,391 A * 11/1995 Gudat et al. ..... 701/50
5,493,494 A * 2/1996 Henderson ..... 701/50
5,942,679 A * 8/1999 Sandstrom ..... 73/78
6,460,006 B1 * 10/2002 Corcoran ..... 702/137
6,619,125 B2 * 9/2003 Laugwitz ..... 73/573
6,821,052 B2 * 11/2004 Zurn ..... 404/84.5
6,973,821 B2 * 12/2005 Corcoran ..... 73/78
7,428,455 B2 * 9/2008 Corcoran ..... 701/50
2006/0034660 A1 * 2/2006 Satzler ..... 404/124
2008/0267719 A1 * 10/2008 Corcoran ..... 405/271
2009/0126953 A1 * 5/2009 Anderegg et al. ..... 172/1
2009/0142133 A1 * 6/2009 Glee et al. ..... 404/75

FOREIGN PATENT DOCUMENTS

EP 0 698 152 B1 2/2006

* cited by examiner

*Primary Examiner*—Michael P Nghiem
*Assistant Examiner*—Cindy H Khuu
(74) *Attorney, Agent, or Firm*—Miles & Stockbridge P.C.; David R. Schaffer, Esq.

(57) ABSTRACT

In a method for determining a compaction degree of a surface segment, the following steps are provided: passing over the deposited layer of the surface segment to be compacted, determining positional data of a position of the compacting machine, defining a current partial surface of the surface segment of the deposited layer, the current partial surface possibly consisting of a plurality of subsegments which have already been passed over, measuring and/or picking up parameters at the position of the compacting machine, and storing the parameters together with the position data, assigning the parameters to the current partial surface or to all subsegments of the current partial surface, computing, from the parameters, a current compaction degree for the current partial surface or each subsegment of the current partial surface.

22 Claims, 4 Drawing Sheets

METHOD FOR DETERMINING A COMPACTION DEGREE OF ASPHALTS AND SYSTEM FOR DETERMINING A COMPACTION DEGREE

BACKGROUND OF THE INVENTION

The present invention relates to a method for determining a compaction degree of layers of hot materials, particularly of asphalt, as well as a system for determining a compaction degree and a compacting machine.

In asphalt road construction, it is presently customary to detect the quality of the asphalt compaction by taking a boring sample and analyzing it in a laboratory. This procedure is problematic because the measurement is performed only by way of spot checks and only after termination of the compacting process. It will not be possible to make an assessment of the whole treated surface. The compacting process will be examined only retroactively and cannot be adjusted already during the treatment.

Further, use is made of electronic probes which are manually applied and are capable of detecting a degree of compaction existing on a given spot. Such electronic probes offer the advantage of delivering individual results already while the compacting is still in progress. Also in this measuring method, however, the spot-wise character of the measurements makes it impossible to obtain results on the whole treated surface.

From the field of earthwork engineering, methods for indirect detection of the compaction degree are already known. In these methods, the rigidity value is computed during the compacting movement of the machine on the basis of acceleration signals of the vibrating roll tire and the underlying ground, using mathematical methods for computation. The results will be plotted and directly visualized to the user via a monitor.

To obtain an areal result already during the compacting process, one has meanwhile proceeded—subsequent to the above described method from earthwork engineering—to apply similar methods also in asphalt paving by trying to determine the rigidity of the asphalt. However, the resulting rigidity value of the condensed asphalt is influenced by a large number of factors. Examples worth mentioning among such factors are an inhomogeneous underlying ground, a varying layer thicknesses, patches and the asphalt temperature. Due to these influencing factors, a rigidity measurement is unsuited for a sufficient evaluation of the quality of the compacting work. These methods are thus hardly useful in the context of asphalt compacting.

Therefore, a considerable need exists for a method adapted to optimize the compacting process already during the processing.

From EP Patent 0 698 152 A1, there are already known a method and a device for determining the compaction degree of a ground surface. To perform the determination process, the ground surface to be treated is first divided into unit surface segments. When a pass is made over given unit surface segment, various data of the unit surface segments (e.g. asphalt temperature or speed of the roll) are detected by suitable sensors or measurement devices. On the basis of these data, the compaction degree of the unit surface segment is computed as a partial compaction effect or a partial index number for the segment that is being passed over. The current total compaction value and respectively total index number for a unit surface segment is obtained by adding the current partial compaction effect or partial index number to the total compaction effect or total index number of the preceding pass of this unit surface segment. In this regard, the method is based on the assumption that the compaction degree will increase quasi-logarithmically along with the number of passes.

A disadvantage of this method resides in the idealized division of the to-be-treated ground surface into unit surface segments. Notably, a typical course of a roadway which also curves can thus not be unambiguously represented by this known approach. This also makes it impossible to perform an unambiguous evaluation of the compacting work, particularly in the edge regions of the ground surface to be compacted. A further problem is caused by the fact that, in practice, the moving paths of the compacting machines do not extend linearly side by side but, instead, the ground is to be processed along mutually overlapping paths. Particularly when using a plurality of compacting machines simultaneously, it will neither be possible nor desirable to perform the movements with rigid tracking. As a result, the case may occur that the unit surface segments are only partially passed over by the compacting machines. If, for instance, it happens that a unit surface segment is several times passed over only on one half but is nonetheless evaluated as fully treated, it will be communicated to the driver that the compacting work for this unit surface segment has already been completed although, in the extreme case, half of this unit surface segment has actually been left untreated.

Thus, it is an object of the present invention to provide a method for determining a compaction degree and a system for performing such method which allow for a more-accurate indication of compaction degrees of a surface to be treated while avoiding the above outlined disadvantages of the state of the art.

SUMMARY OF THE INVENTION

According to the method of the invention, it is provided that, for determining a compaction degree of a surface segment to be compacted—wherein the self-compacting surface segment comprises a deposited layer of a hot material, particularly asphalt, and the material will continuously cool down after being deposited—the deposited layer of the surface segment to be compacted will first be passed over by at least one compacting machine. In the process, position data indicating a position of the compacting machine are determined by a positioning system. In dependence on the current position of the compacting machine and at least the dimensions of the compacting machine, a current partial surface of the surface segment of the deposited layer is determined. If the current partial surface is located partly or wholly on parts of the to-be-compacted surface segment that have already been passed over, the current partial surface can also consist of a plurality of subsegments which have already been passed over. Parameters of a position of the compacting machine that are useful for determining the compacting effect are measured and/or picked up and are stored together with the position data. These parameters will then be assigned to the current partial surface or to all subsegments of the current partial surface. On the basis of the stored parameters, a current compaction degree of the current partial surface or each subsegment of the current partial surface is computed. By repetition of the above mentioned steps, a plurality of parameters will be stored together with the position data assigned to various partial surfaces or subsegments of partial surfaces. When repeating the above mentioned steps, the parameters stored during previous passes for the current to-be-computed partial surface or for the to-be-computed subsegment of the current partial surface, together with the current parameters for the current partial surface or for the to-be-computed subsegment of the current partial surface, will then be the input parameters of the computation process.

Thus, in the performed computation, all of the parameters which earlier have been stored for a surface will be used for the computation of the compaction degree. Consequently, when computing the current compaction degree, it is made possible to take into account the history of the compacting treatment of the current partial surface or of the subsegment of the current partial surface because the current compaction degree can always be computed from all measured or picked-up raw data, instead of merely computing partial increases of compaction and then to add these to a previously computed total compaction.

For instance, as has become evident from test measurement runs, a pass over asphalt will cause anomalies to be generated which cannot be taken into account by the assumption of a quasi-logarithmic development of the compaction relative to the number of passes. In the test series, is turned out that about 30% of the passes may involve the occurrence of anomalies wherein the compaction degree of a pass is reduced as compared to the preceding pass. In the computation of the current compaction degree, however, such anomalous results can be computed only by consideration of the history of the compacting work.

Preferably, the sizes of a partial surface and/or of the subsegments of a partial surface are variable.

Also the length of the subsegments in a partial surface can be variable.

The size of the subsegments of a partial surface and/or the position of a subsegment in a partial surface can be determined in dependence on the overlapping of the partial surface with at least one partial surface and/or at least one subsegment of a partial surface of a preceding pass.

The size of the subsegments of a partial surface and/or the position of a subsegment in a partial surface can be determined in dependence on one or a plurality of the parameters.

By the variable division of the partial surfaces and respectively subsegments and by the variable position of the subsegments in a partial surface, it is rendered possible to represent the development of a to-be-compacted traffic surface with high precision. It is further possible to represent and take into account overlapping moving paths of the compacting machine(s).

The subsegments will preferably be determined in dependence of the number of passes with regard to the size and the position in a partial surface. Thus, the computation of the current compaction degree of this subsegment for the current pass has to be computed only once because consistent parameters have been stored for the whole subsegment. Thus, for a current partial surface, it is only for each subsegment of the current partial surface that a computation has to be performed, resulting in a merely low number of required computations. In case that a partial surface comprises no subsegments, notably if a current partial surface is congruent with a partial surface of preceding pass, only one computation of the compaction degree has to be performed for this partial surface.

Therefore, the above mentioned determining of the partial surfaces and subsegments will allow for an efficient and fast computation of the compaction degree.

The parameters from which the current compaction degree is computed can include the number of passes, the layer temperature, the speed of the compacting machine, the frequency of the roll tire, the amplitude of the roll tire, the type of the compacting machine, the mass of the compacting machine, the cooling behavior of the layer, the type of compacting, the composition of the layer and/or the steering angle of the compacting machine.

Further, it is advantageously provided that at least one further parameter will be preset at the start of the method for use as a fixed parameter. Such a parameter can be e.g. the asphalt mixture, the weight of the compacting machine, or the type of compacting.

Of course, the option exists to change the fixed parameter while performing the method. In case, for instance, that the compacting type is preset as a fixed parameter and is further specified as compacting by "vibration", it is possible, after a region of the surface segment has been passed over, to change this parameter to "oscillation" or "static" if the compacting machine is to perform the compacting in this manner during the further progress of the method.

According to a preferred variant, it is provided that at least one stored parameter of a partial surface or a subsegment of a preceding pass will be corrected in dependence on a parameter-representing partial surface and/or a time component.

In this manner, it is rendered possible to continuously correct e.g. the stored parameter of the cooling behavior of a partial surface on the basis of information obtained from current measurements of the cooling behavior or the temporal development of the cooling behavior. This allows for very precise computation of the compaction degree. Further, the possibility exists to compute at least one parameter of the current partial surface or of a subsegment in dependence on a parameter of the current partial surface. Thus, for instance, the parameter of the cooling behavior can be derived from the parameter of the layer temperature in connection with the layer temperature of the preceding pass.

According to a preferred variant of the invention, it is provided that treatment priorities for a partial surface and/or a subsegment of a partial surface are computed.

In doing so, the priority can be computed from the current compaction degree, the number of passes, a time component, and/or individual parameters such as e.g. the cooling behavior of a layer.

With reference of the treatment priority, it can be determined which partial surface or which subsegment of a partial surface has to be treated next so as to achieve a good compaction degree. For instance, if a risk exists that the temperature of a partial surface or a subsegment of a partial surface of the surface segment to be compacted might become too low for treatment, the computed pass-over priority for this region will be very high so that it can be judged that this region should be treated next.

The invention advantageously provides that, in a next step, the surface segment is graphically represented, with a respective graphical representation being generated of the current compaction degree, individual parameters and/or the treatment priority for each partial surface and/or for each subsegment of a partial surface. The graphical representation of the above mentioned information makes it possible for the operator of a compacting machine to control the machine to the effect that the best possible treatment result is reached for the surface segment to be compacted.

Also, it can be provided that, in a further method step, that position data can be computed from the current position data and the position data of the partial surfaces and/or the subsegments of a partial surface with the highest treatment priority, and that these data can be displayed. In this manner, to indicated to the operator of the compacting machine e.g. the distance and direction towards those regions of the surface segment to be compacted which have to be compacted soon. In the process, the computation of the navigation data can also take into account a time component as well as the speed of the compacting machine, which makes it possible top compute and display the optimum route with regard to the treatment priorities.

Further, the invention advantageously provides that data, preferably the measured and respectively picked-up parameters along with positional data, are transmitted to at least one further compacting machine and/or to a central processing unit so that, in a network comprising a plurality of compacting machines, all compacting machines will have at their disposal also the data of the respective other compacting machines. Thus, when computing the current compaction degree, it is possible to take into account not only the pass of one compacting machine but the passes of all compacting machines. In this manner, a plurality of compacting machines can work cooperatively, and the current compaction degree of the interesting region of the to-be-compacted surface segment can be computed under consideration of the compacting work of all machines.

According to the invention, there is further provided a system for performing the above described method. In this system, it is advantageously provided that the positioning system comprises a position data receiver for reception of satellite-based position data.

By way of alternative or addition to the above, the positioning system can comprise an optical position determining system, preferably a laser positioning system.

In this manner, the position of the compacting machine can be determined very precisely and conveniently. Using an optical positioning system, it is also possible to determine the position of the compacting machine in situations that to not allow for a satellite-based position determination, such as e.g. in a tunnel.

An embodiment of the invention will be explained in greater detail hereunder with reference to the Figures.

DETAILED DESCRIPTION OF A PREFERRED EMBODIMENT

Figure 1:
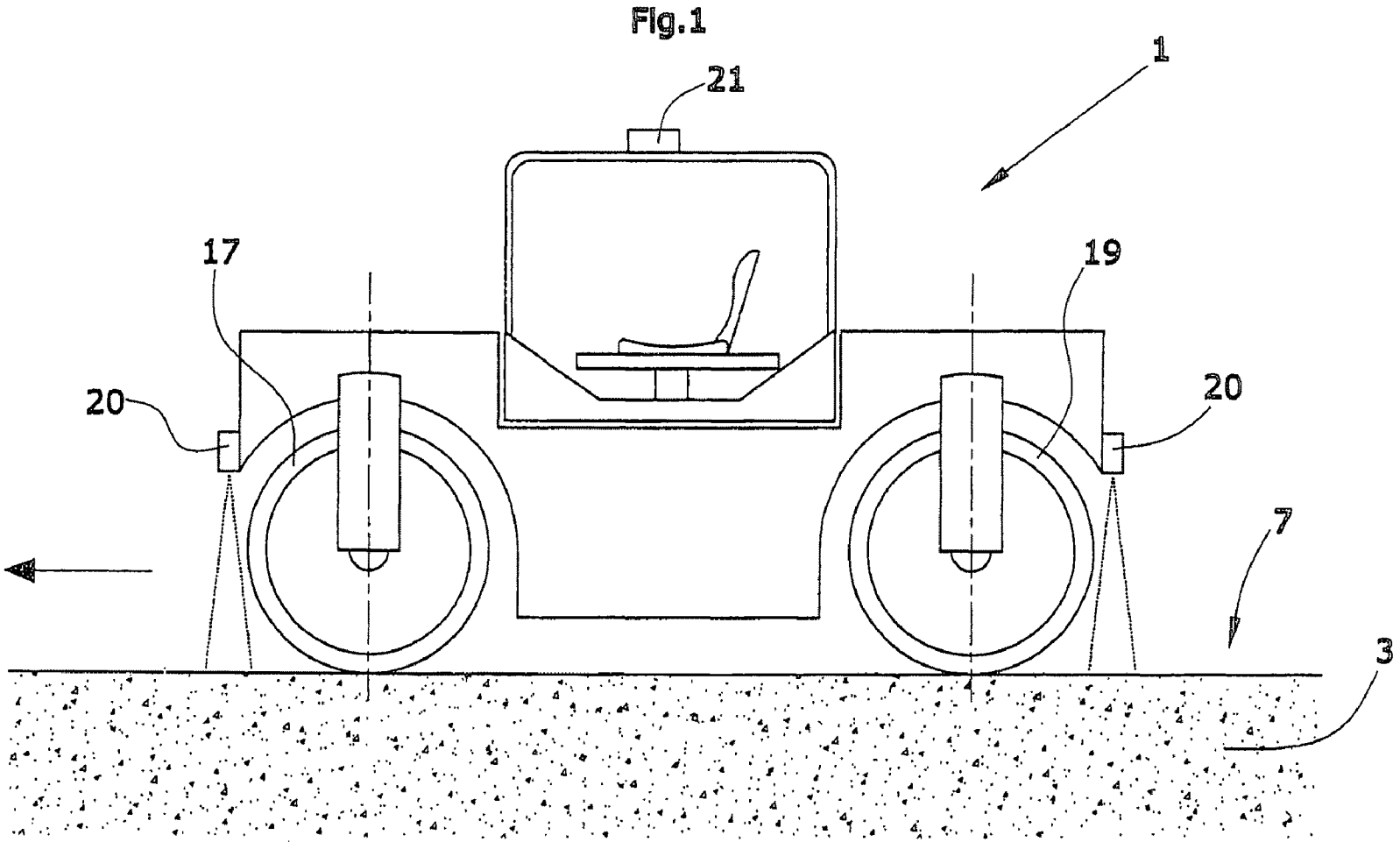
FIG. 1 is a schematic view of a compacting machine.

FIG. 1 schematically illustrates a compacting machine 1 for use in performing the inventive method for determining a compaction degree of a surface segment 7 of a traffic surface that is to be compacted. The to-be-compacted surface segment 7 of the traffic surface comprises a deposited layer 3 of a hot material. The hot material can be e.g. asphalt. The compacting machine 1 passes over the a to-be-compacted surface segment 7 in the moving direction as indicated by the arrow in FIG. 1. In this process, the front roll tire 17 as seen in the moving direction and the rear roll tire 19 as seen in the moving direction will compact the deposited layer 3. During the pass, the surface temperature of the deposited layer 3 is measured by temperature sensors. The temperature sensors 20 schematically outlined in FIG. 1 are contactless infrared thermometers adapted to measure the temperature of the surface of the deposited layer across a distance. Of course, also other temperature measurement methods are applicable.

Compacting machine 1 is provided with a position data receiver 21 of a positioning system, which receiver can be e.g. a GPS receiver. By use of the position determining system, the position of the compacting machine can be determined. Further sensors (not illustrated) can be used for measuring the speed of the compacting machine, the frequency of the roll tire, the amplitude of the roll tire and the steering angle of the compacting machine. In the inventive method, it can further be provided that the number of passes will be registered and that the type of the compacting machine, the mass of the compacting machine, the type of compacting and the composition of the layer are predetermined.

When performing the inventive method, the deposited layer 3 of the surface segment 7 to be compacted is passed over by the compacting machine 1.

Using the position data receiver 21 of the positioning system, the position of compacting machine 1 is determined. In the process, position data receiver 21 will receive position data from a satellite, out of which data a position can be computed. Alternatively or additionally thereto, compacting machine 1 can be provided with an optical positioning system, e.g. a laser positioning system, allowing for a position determination e.g. when passing through a tunnel where a position determination by use of the satellite-based position determining system is not feasible.

Figure 2B:
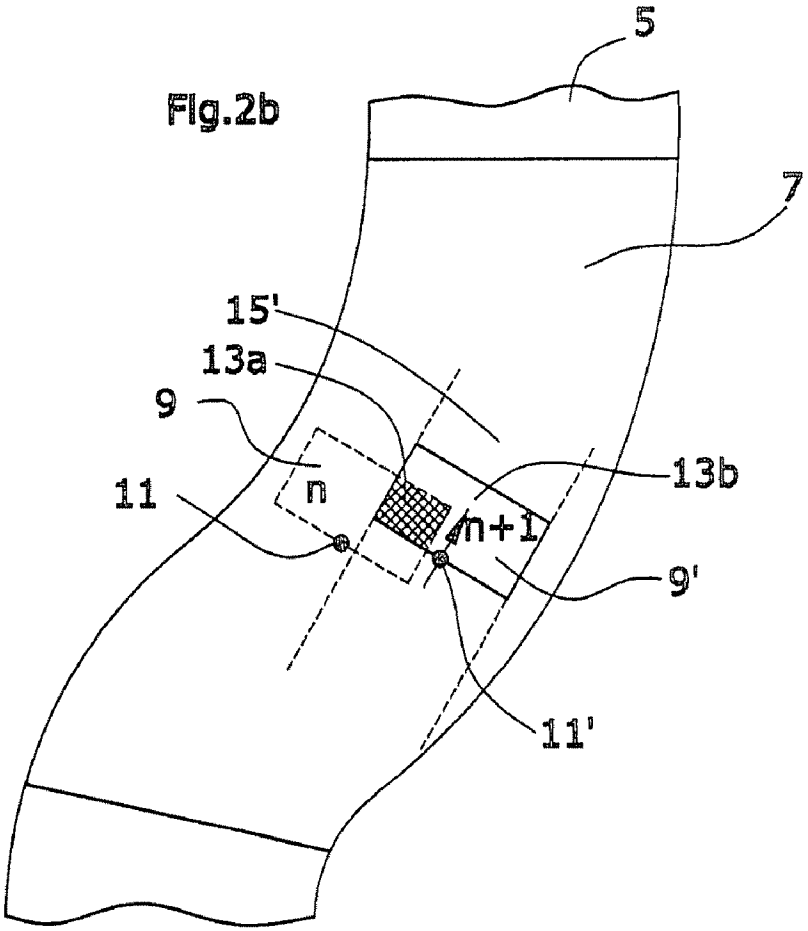
FIG. 2 is a schematic view of a to-be-compacted surface segment of a traffic surface.
Figure 2A:
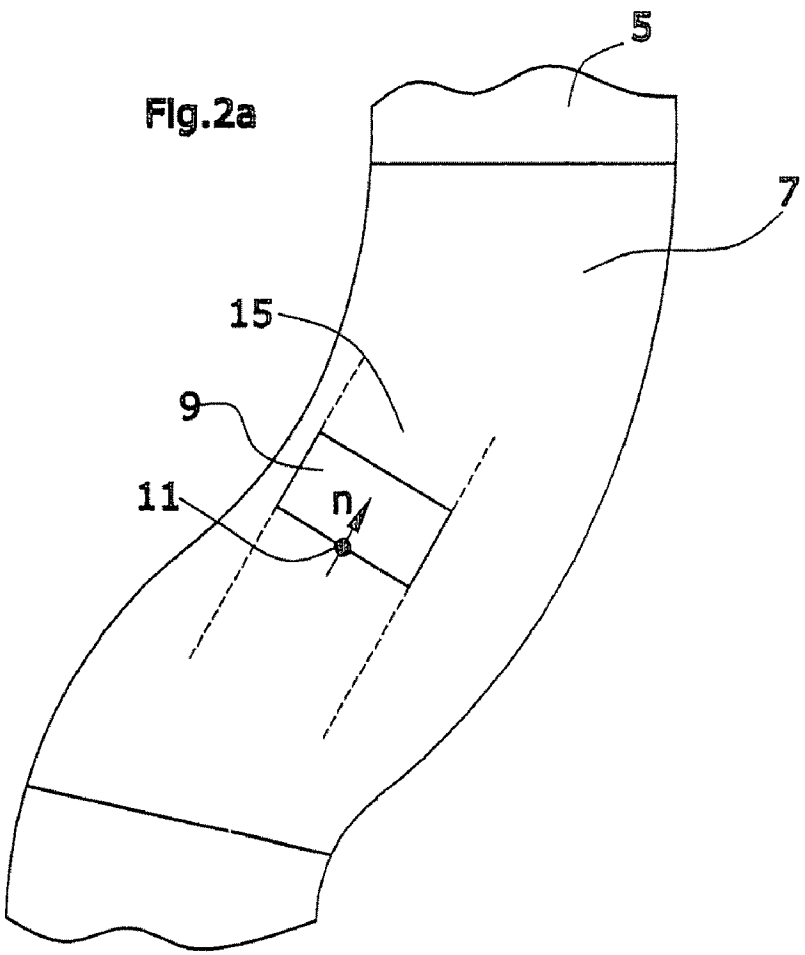

In FIG. 2*a*, the to-be-compacted surface segment 7 of a traffic surface 5 is illustrated. Reference numeral 15 indicates the schematically illustrated moving path of a compacting machine. The point marked by reference numeral 11 in the middle of the moving path represents the position of the compacting machine as determined by the positioning system. After determination of the position of the compacting machine, a vector pointing in the moving direction of the compacting machine will be placed into the position of the compacting machine. In dependence of this position, of said vector and of the size of the compacting machine, particularly of the width of the roll tires of the compacting machine, a partial surface 9 of surface segment 7 will be defined. For the above-mentioned position of the compacting machine, suitable parameters for determining the compacting effect are measured or picked up. As described above, such parameters can be e.g. the layer temperature, the speed of the compacting machine, the frequency of the roll tire, the amplitude of the roll tire, and the steering angle of the compacting machine. Further, the number of passes will be registered. In the example shown in FIG. 2*a*, the number of passes is represented by n.

On the basis of the layer temperature, it is possible, by detecting the temperature difference between the current layer temperature and the layer temperature of a preceding pass, to determine the cooling behavior of the layer. There is also the option, by use of corresponding sensors, to measure meteorological data such as e.g. outdoor temperature, wind speed, atmospheric pressure, atmospheric humidity for use of these meteorological data when determining the cooling behavior. As already mentioned, it is possible in the inventive method to preset the type of compacting machine, the mass of the compacting machine, the type of compacting and the composition of the layer as fixed parameters.

In the further course of the method, the parameters are assigned to the partial surface 9. In this regard, it is not positively required to also assign the fixedly preset parameters to the partial surface, as long as it can be assumed that these parameters are valid for the whole surface segment which is to be compacted.

From the totality of these parameters, the compaction degree of the current partial surface 9 is computed.

Shown in FIG. 2*b* is the surface segment 7 of traffic surface 5 during a further pass n+1 of the compacting machine. The moving path of the compacting machine is marked by reference numeral 15'. The partial surface 9 determined according to FIG. 2*a* in the position 11 of the compacting machine is schematically outlined by interrupted lines. As can be seen in FIG. 2*b*, the moving path 15' of the pass n+1 overlaps with the moving pass of the previous pass n. At the position 11' of the pass n+1, in turn, a partial surface 9' is determined. The determining of partial surface 9' is performed in dependence on the position 11', the dimensions of the compacting machine and the moving direction represented by the vector passing through point 11'. On the basis of the parameters stored during the pass n, particularly the number of passes, the working system will detect that an overlapping of the moving paths has occurred. For this reason, the partial surface 9' will be divided into two subsegments 13*a* and 13*b*. At the position 11', a parameter is again measured and picked up. These parameters will be assigned to the partial surface 9' and respectively to the individual subsegments 13*a* and 13*b* of partial surface 9'.

Subsequently, the compaction degree of partial surface 9' is computed. Since, according to the inventive method, the computation of the compaction degree is performed under consideration also of all parameters previously stored for the region of a partial surface or a subsegment, computing the compaction degree of partial surface 9' requires that a respective computation is performed for each subsegment 13*a*, 13*b*. For computing the compaction degree of subsegment 13*a*, use is made of the parameters of pass n+1 and of the parameters of the pass n because the subsegment 13*a* is located on partial surface 9 of pass n. In the illustrated example, for subsegment 13*b*, only the parameters measured and respectively picked up at the position 11' for the pass n+1 are used in the computation of the compaction degree. In case that, within subsegment 13*b*, partial surfaces or subsegments of preceding passes are arranged, subsegment 13*b* will be divided corresponding to the borders of the partial surfaces or subsegments so that partial surface 9' will consist of more than two subsegments. Then, a compaction degree is correspondingly computed for each of the subsegments.

In this manner, when repeating the passes according to the present method, the whole surface segment to be compacted will be divided into partial surfaces which will travel along with the compacting machine, wherein the sizes and the positions of the partial surfaces are variable. By the overlap of the moving paths of the compacting machine, the current partial surfaces are divided into subsegments of decreasing sizes, thus allowing for a very accurate measurement of the compaction degree of the compacted surface segment.

In the above described method, it is made possible that an already stored parameter for a partial surface, e.g. partial surface n, is corrected in dependence on a parameter of the current partial surface, e.g. partial surface 9', and/or a time component. This parameter can be e.g. the cooling behavior of the layer. If, for instance, the parameter of the cooling behavior of the layer during pass n+1 makes it evident that, due to the temporal distance between pass n+1 and pass n and/or due to varying weather conditions, the cooling behavior of the layer previously stored for partial surface 9 during pass n cannot correspond to reality, this parameter which has been stored for partial surface 9 can be corrected correspondingly. It is also possible, instead of correcting the stored parameter, to store a new parameter for the partial surface 9 that is provided with a corresponding time stamp.

In this manner, the history of the treatment and of the cooling of a surface segment can be stored with high accuracy, allowing for a very useful temperature prognosis for the to-be-compacted surface segment to be generated.

Since hot asphalt can be condensed only above a specific temperature and a condensation is not effectively possible anymore below this temperature, a treatment priority for a partial surface and/or a subsegment of a partial surface can be computed with the aid of the temperature prognosis and respectively with the aid the cooling behavior of the layer.

The inventive method further provides that the surface segment of the traffic surface to be treated is visualized. Thus, the surface segment will be graphically represented, the representation including the current compaction degree, individual parameters and/or the treatment priority of each partial surface and/or of each surface segment of a partial surface. When visually representing the treatment priority, the individual partial surfaces and/or the subsegments are marked by colors corresponding to their priority. For instance, the partial surfaces and/or subsegments of the highest treatment priority could be represented by a warning color, e.g. red, or with a flashing effect, allowing the operating person of a compacting machine to immediately identify those regions which have to be treated next so as to achieve a good compaction result. In the inventive method, it is further possible, on the basis of the current position data and the position data of the partial surfaces and/or subsegments of a partial surface with high treatment priorities, to compute navigation data which will be communicated to the operating person e.g. in the form of distance and direction. As a consequence, the navigation data can be used for computation of a route indicating the optimum path to the treatment of partial surfaces and respectively subsegments with the highest treatment priorities. This allows for a very effective treatment with a very good compaction result.

To make it possible to treat the to-be-compacted surface segment by use of a plurality of compacting machines, it is provided that the individual compacting machines will transmit their measured or picked-up data and the associated position data to the other compacting machines, e.g. by radio transmission, so that all compacting machines will have available to them also the data of the respective other compacting machines. Further, it can be provided that the compacting machines will transmit said data to a central processing unit which in turn will perform a corresponding distribution of the data to the other compacting machines. In such a network comprising a plurality of compacting machines, it is also possible that each machine itself will on the basis of the available data compute the corresponding compaction degrees and priorities. It is also possible to have the data collected in the central processing unit and to have the corresponding computations performed in this unit. Subsequently, the results are transmitted to the compacting machines to be visually represented for the operator's attention.

Figure 3:
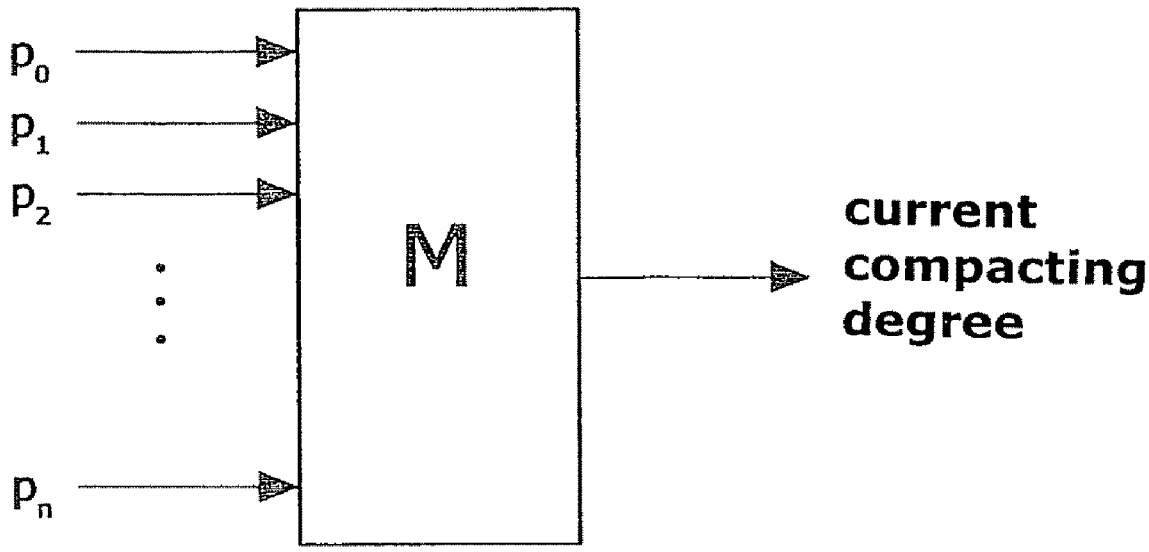
FIG. 3 is a diagrammatic representation of the computation of the current compaction degree.

FIG. 3 shows a diagrammatic representation of the computation of the current compaction degree. In this representation, $p_n$ represents a set of parameters picked up for the pass n. This set of parameters $p_n$ comprises the above described measured and respectively picked-up parameters as well as the fixedly preset parameters. The computation method shown in FIG. 3 is the computation method either for a partial surface or for a subsegment of a partial surface. As already described in the context of FIGS. 2*a*, 2*b*, the partial surface will be defined in dependence on the overlap with previous passes. For this process of defining the subsegment, it is decisive that the whole subsegment throughout has the same treatment history, i.e. that the same sets of parameters $p_0$-$p_n$ exist for the whole subsegment. In the computation model M, the current compaction degree is computed from the sets of parameters $p_0$-$p_n$. The computation model M has been established with the aid of plural test series. In the computation model, the parameters of the individual sets of parameters $p_0$-$p_n$ are connected to each other by a neural network so that the current compaction degree can be computed.

Figure 4:
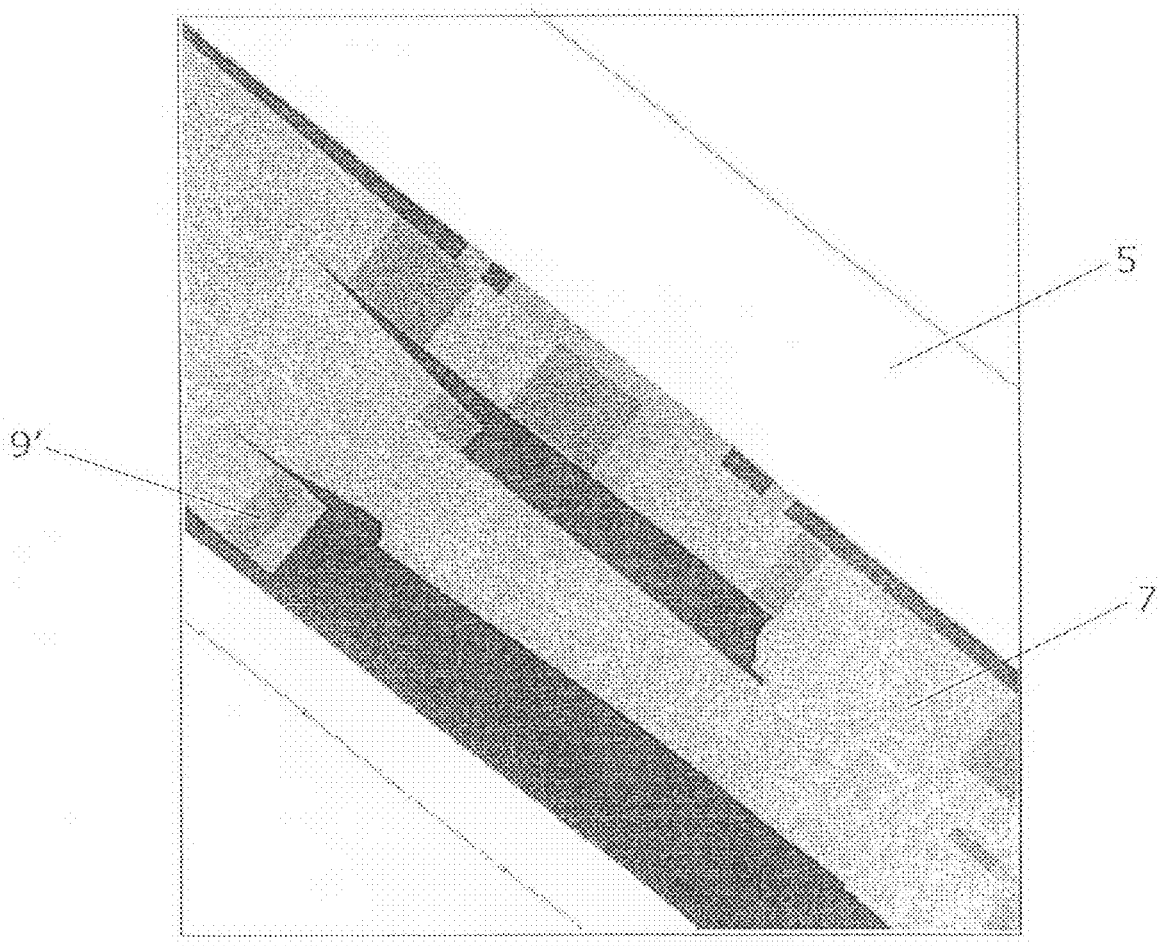
FIG. 4 is an exemplary representation of the compaction degree of a to-be-compacted surface segment of a traffic surface.

FIG. 4 shows a graphic representation of the compaction degree of a to-be-compacted surface segment 7 of a traffic surface 5. In the graphical representation of FIG. 4, the various shades of grey indicate various compaction degrees. Of course, in lieu of said grey-scale representation, also a colored representation can be used.

As evident from the representation in FIG. 4, the different passes performed within surface segment 7 have resulted in different compaction degrees for different partial surfaces and respectively subsegments of partial surfaces. Indicated by reference numeral 9', for instance, is a subsegment which has been marked by a color corresponding to the computed compaction degree.

Thus, the representation by the varying colors serves to indicate to the operators of the compacting machine the individual compaction degrees of the to-be-compacted surface segment so that the compacting machines can be steered to the corresponding sites which still have a too low compaction degree.

In the method of the invention, it is also possible to measure and respectively pick up two sets of parameters for one position of the compacting machine and to assign these sets of parameters to two partial surfaces. For instance, a partial surface can extend forward in the moving direction from the center—shown in FIG. 1—of front roll tire 17 projected onto the asphalt layer, and the second partial surface can extend forward in the moving direction from the rear roll tire's center projected onto layer 3.

As detailed above, the partial surfaces are defined in dependence on the position of the compacting machine. In doing so, the range of the partial surface is defined in dependence on the dimensions of the compacting machine, particularly in dependence on the width of the roll tire of the compacting machine, so that the width of a partial surface will correspond to the width of a roll tire.

Of course, it is also possible to perform the inventive method by use of compacting machines having only one roll tire.

In the compacting machine shown in FIG. 1, a respective temperature sensor is arranged upstream of the front roll tire 17 and downstream of the rear roll tire 19. Both temperature sensors 20 detect the surface temperature of the layer 3. Due to the distance between the temperature sensors and due to the water which, during treatment of the layer 3, is sprayed onto the roll tires 17,19 for cooling and thus, from roll tires 17 and 19, is in turn applied to the surface of layer 3, the surface temperatures of layer 3 detected by the two temperature sensors 20 are different. For this reason, the layer temperature used in the inventive method is detected under observance of a fixed weighting ratio between the two temperatures. It can also be provided that the weighting of the temperatures used for detection of the layer temperature is variable, e.g. in dependence on the quantity of cooling water applied onto the roll tires 17 and 19. The temperature measurement of the surface temperature of layer 3 by use of two temperature sensors which in the moving direction are arranged upstream of the front roll tire and downstream of the rear roll tire, will also be possible independently of the above described inventive method for determining the compaction degree of a to-be-compacted surface segment of a traffic surface, so that said method for determination of a layer temperature with weighting of the detected temperatures is applicable also in other processes, e.g. in stiffness measurement.

What is claimed is:

1. A method for determining a compaction degree of a surface segment of a traffic surface that is to be compacted, where said surface segment which is to be compacted comprises a deposited layer of a hot material, particularly asphalt, and where said material will continuously cool down after deposition, said method including the following steps:

a) passing over the deposited layer of the surface segment to be compacted, by use of at least one compacting machine, b) determining positional data of a position of the compacting machine by use of a positioning system, c) defining a current partial surface of the surface segment of the deposited layer in dependence on the position of the compacting machine and at least on a dimensions of the compacting machine, said current partial surface consisting of a plurality of subsegments which have already been passed over, wherein a size of the current partial surface and/or of the subsegments of the current partial surface are variable or that a position of the subsegments in the current partial surface is variable, and wherein the size of the subsegments of the current partial surface and/or the position of the subsegments in the current partial surface are determined in dependence on an overlap of a previous partial surface with at least another previous partial surface and/or with at least one subsegment of previous passes, d) measuring and/or picking up parameters at the position of the compacting machine, which parameters are useful in the determining of a compacting effect, and storing said parameters together with the position data, e) assigning the parameters to the current partial surface or to all subsegments of the current partial surface, f) computing, from said parameters, a current compaction degree for the current partial surface or each subsegment of the current partial surface, g) repeating the steps a) to f) in such a manner that, in step f), the parameters which have been stored during previous passes for the current partial surface or each subsegment are each a part of the parameters to be included in the computation.

2. The method according to claim 1, characterized in that the size of the subsegments of the current partial surface and/or the position of the subsegment in the current partial surface are determined in dependence on one or a plurality of said parameters.

3. The method according to claim 1, characterized in that at least one further parameter is preset as a fixed parameter prior to step a).

4. The method according to claim 1, characterized in that at least one stored parameter of a preceding partial surface or of a subsegment of a preceding pass is corrected in dependence of a parameter of the current partial surface and/or a time component.

5. The method according to claim 1, characterized in that at least one parameter of the current partial surface or of the subsegment of the current partial surface is computed in dependence on a parameter of the previous partial surface.

6. The method according to claim 1, characterized in that said parameters comprise a number of passes, a layer temperature, a speed of the compacting machine, a frequency of a roll tire, a amplitude of the roll tire, a type of the compacting machine, a mass of the compacting machine, a cooling behavior of the deposited layer, a type of compacting, a composition of the deposited layer and/or a steering angle of the compacting machine.

7. The method according to claim 1, further including the step of computing a treatment priority for the current partial surface and/or for a subsegment of the current partial surface.

8. The method according to claim 7, characterized in that the treatment priority is computed on a basis of the current compaction degree, a number of passes, a time component, and/or individual parameters, preferably a cooling behavior of the layer.

9. The method according to claim 1, further including the step of graphically representing the surface segment, said representation including the current compaction degree, mid/or individual parameters, and/or a treatment priority for each partial surface and/or for each subsegment of the current partial surface.

10. The method according to claim 7, further including the step of computing navigation data from the position data of the compacting machine and the position data of the current partial surfaces and/or subsegments of the current partial surface having the highest treatment priorities, and of displaying the navigation data.

11. The method according to claim 1, further including the step of transmitting data, preferably parameters with position data of the current partial surfaces and/or subsegment of the current partial surface, to at least one further compacting machine and/or a central processing unit in such a manner that, in a network comprising a plurality of compacting machines, where all of the compacting machines are allowed to access the position data of respectively other compacting machines.

12. A system for performing the method according to claim 1.

13. The system according to claim 12, characterized in that said position determining system comprises a position data receiver for reception of satellite-based position data.

14. The system according to claim 12, characterized in that said position determining system comprises an optical positioning system, preferably a laser positioning system.

15. A compacting machine comprising the system according to claim 12.

16. The compacting machine according to claim 15, characterized by at least two temperature sensors for measuring a temperature of the deposited layer, a parameter of a layer temperature being computed from the temperatures measured by the sensors.

17. The system according to claim 16, characterized in that, when seen in a driving direction of the compacting machine, one of said temperature sensors is arranged upstream of a front axle and another of said temperature sensors is arranged downstream of a rear axle of the compacting machine.

18. The system according to claim 16, characterized in that the parameter of the layer temperature is computed by weighting the measured temperatures.

19. A method for determining a compaction degree of a surface segment of a traffic surface that is to be compacted, where said surface segment which is to be compacted comprises a deposited layer of a hot material, particularly asphalt, and where said material will continuously cool down after deposition, said method including the following steps:

a) passing over the deposited layer of the surface segment to be compacted, by use of at least one compacting machine, b) determining positional data of a position of the compacting machine by use of a positioning system, c) defining a current partial surface of the surface segment of the deposited layer in dependence on the position of the compacting machine and at least on a dimensions of the compacting machine, said current partial surface consisting of a plurality of subsegments which have already been passed over, d) measuring and/or picking up parameters at the position of the compacting machine, which parameters are useful in the determining of a compacting effect, and storing said parameters together with the position data, e) assigning the parameters to the current partial surface or to all subsegments of the current partial surface, f) computing, from said parameters, a current compaction degree for the current partial surface or each subsegment of the current partial surface, g) repeating the steps a) to f) in such a manner that, in step f), the parameters which have been stored during previous passes for the current partial surface or each subsegment are each a part of the parameters to be included in the computation, and h) computing, from said current compaction degree, a treatment priority for the current partial surface and/or for the subsegment of the current partial surface.

20. The method according to claim 19, characterized in that the treatment priority is computed on a basis of the current compaction degree, a number of passes, a time component, and/or individual parameters, preferably the cooling behavior of the deposited layer.

21. The method according to claim 19, further including the step of computing navigation data from the position data of the compacting machine and the position data of the current partial surfaces and/or subsegments of the current partial surface having the highest treatment priorities, and of displaying the navigation data.

22. A computing machine comprising:

at least two temperature sensors for measuring a temperature of a deposited layer, where a parameter of a layer temperature being computed from the temperature measured by the sensors; and a system, when seen in a driving direction of a compacting machine, one of said temperature sensors is arranged upstream of a front axle and another of said temperature sensors is arranged downstream of a rear axle of the compacting machine, wherein the system further performs a method for determining a compaction degree of a surface segment of a traffic surface that is to be compacted, where said surface segment which is to be compacted comprises a deposited layer of a hot material, particularly asphalt, and where said material will continuously cool down after deposition, said method including the following steps:

a) passing over the deposited layer of the surface segment to be compacted, by use of at least one compacting machine, b) determining positional data of a position of the compacting machine by use of a positioning system, c) defining a current partial surface of the surface segment of the deposited layer in dependence on the position of the compacting machine and at least on a dimensions of the compacting machine, said current partial surface consisting of a plurality of subsegments which have already been passed over, d) measuring and/or picking up parameters at the position of the compacting machine, which parameters are useful in the determining of a compacting effect, and storing said parameters together with the position data, e) assigning the parameters to the current partial surface or to all subsegments of the current partial surface, f) computing, from said parameters, a current compaction degree for the current partial surface or each subsegment of the current partial surface, and g) repeating the steps a) to f) in such a manner that, in step f), the parameters which have been stored during previous passes for the current partial surface or each subsegment are each a part of the parameters to be included in the computation.

* * * * *